US005331719A

United States Patent [19]

Hum et al.

[11] Patent Number: 5,331,719

[45] Date of Patent: Jul. 26, 1994

[54] DOOR STOP

[76] Inventors: Tom P. Hum, 10 Plentywood Bay, Regina, Saskatchewan S4R 7L4; Leon L. Froess, 543 Dorothy Street, Regina, Saskatchewan S4T 5T7, both of Canada

[21] Appl. No.: 20,980

[22] Filed: Feb. 22, 1993

[51] Int. Cl.[5] ..... E05C 17/00; E05C 17/54

[52] U.S. Cl. ..... 16/85; 292/343; 292/DIG. 15

[58] Field of Search ..... 267/30, 158, 164; 16/82, 85, 86 A, 86 R; 292/288, 343, DIG. 15

[56] References Cited

U.S. PATENT DOCUMENTS

| | | | |
|---|---|---|---|
| 1,833,773 | 11/1931 | Brooks | 16/85 |
| 2,048,274 | 7/1936 | Luby | 292/343 |
| 2,487,424 | 11/1949 | Drake et al. | 16/85 |
| 2,784,443 | 3/1957 | Von Berg | 16/85 |
| 3,054,632 | 9/1962 | Welch | 16/85 |
| 4,044,424 | 8/1977 | Sasgen | 16/85 |

*Primary Examiner*—Lowell A. Larson
*Assistant Examiner*—Donald M. Gurley
*Attorney, Agent, or Firm*—Adrian D. Battison; Stanley G. Ade; Murray E. Thrift

[57] ABSTRACT

A door stop is formed from a single flexible band of sheet metal which is symmetrical about a transverse center line and includes an arch shaped central section and two end portions. An underside of one end portion includes a high friction material while the underside of the other end portion is free from that material. The only engagement with the door is provided by the frictional engagement of a high friction material on a center section engaging the bottom edge of the door. The device can thus be used from either direction and provides a symmetrical force on the door preventing movement relative to the stop in either direction.

4 Claims, 3 Drawing Sheets

DOOR STOP

BACKGROUND

1. Field of Invention

This invention is a new device suitable for holding a door in a stationary position and prevent a door from swinging open or closed.

The device is a curved spring constructed with steel or similar compatible materials. In operation the spring is loaded by flattening the springs fabricated curve. When the spring tries to return to its original curvature, an expansive force is generated. This expansive force under the door holds the door stationary.

2. Discussion of Prior Art

Available on the market today are the following devices and methods to hold a door in a stationary position.

(A) Triangular Shaped Devices;

This is the most common device to hold a door stationary. The bottom of the door is forced onto a triangular shaped device or shim. This action twists and lifts the door whereby the weight and torque of the door compresses the shim. This compression force is transferred through the shim and onto the floor. The vertical force generated by the door and the friction between the door to shim and shim to floor prevents the door from swinging.

The disadvantages of triangular shim devices are:

(a) A triangular shim device is unidirectional. This is because a triangular shim can only prevent a door from swinging in one direction but free to move in the opposite direction. Also a triangular shim can only be engaged from one side of a door's swing since the door must be pulled up the slope of the shim.

(b) The shim material may relax under load, losing its expansive force and allows the door to move.

(c) The holding force on the door is determined by the initial loading of the door onto the shim. A stronger person will impose a larger holding force for the door than a weaker person.

(B) Magnetic Devices and Hooks:

These require exact alignment of the door to the magnet or hook to work. Also a door can only be opened to a predetermined position. This may not always be desirable.

(C) Heavy Objects:

A heavy object such as a chair or a brick is used to block a door open. This method is not desirable because the object restricts a doorway's clearance.

(D) Many devices have also been proposed in prior patents including U.S. Pat. No. 4,976,479 (Lunn). This discloses a spring arrangement covered by a rubber frictional coating which provides a base plate for resting on the floor and a spring plate at an angle to the base plate to form a spring wedge.

SUMMARY OF THE INVENTION

According to the invention there is provided a door stop comprising a spring strap member formed of a thin sheet material and shaped to form a central portion, a first end portion and a second end portion arranged at opposed ends of the central portion, the central portion being raised relative to a common plane containing the end portions, a top surface of the central portion defining an upwardly facing door engaging surface for engaging a bottom edge of the door to be stopped, the end portions each defining a downwardly facing floor engaging foot surface, the strap member being elastically deformable to compress the central portion to engage under the bottom edge of the door, elastic force from the strap member applying upward force onto the bottom edge, the door engaging surface of the central portion and the foot surface of the first end portion having a friction material thereon of higher frictional characteristics than that of the foot surface of the second end portion.

OBJECTS AND ADVANTAGES

Accordingly several objects and advantages of the invention are:

(a) This invention is a light weight and easy to use device to hold a door in a stationary position.

(b) This device is bidirectional. It can prevent the door from swinging in either direction and can be engaged from either side of the door. This advantage permits a door to be bumped accidentally on either side and the device will hold the door stationary.

(c) An advantage of this new door stop is its ability to exert a constant repeatable expansion force between the bottom of a door and the floor to hold the door in a stationary position.

(d) This invention is superior for doors with very low clearance between the bottom of door and the floor. It is also ideal for doors having a larger than normal gap between the bottom of door and the floor.

(e) This invention is very compact and will not restrict a doorway's clearance.

(f) This device can be operated by a strong or weak person with 100% efficiency.

(g) This device can be used anywhere along the door's swing arc.

DETAILED DESCRIPTION

The door stop of the present invention comprises a strap of spring steel or similar material which is simply formed into an arc shape so as to form a central portion 10 and two end portions 11 and 12 each at a respective end of the central portion. The strap is bent to form an arch shaped so that the central portion is raised from a horizontal plane containing the two end portions. In the embodiment shown the arch is a smooth curve but this is not entirely necessary and other shapes be possible, just requiring that the central portion is raised. The manufacture of the strap member from spring steel or the like allows the central portion to be compressed by pressure from the foot of the user downwardly into the plane of the two end portions.

At the end portions, the strap is formed so as to define two flat portions each defining a flat undersurface to engaging the floor in the form of a foot surface to apply frictional contact to the floor.

Figure 4:
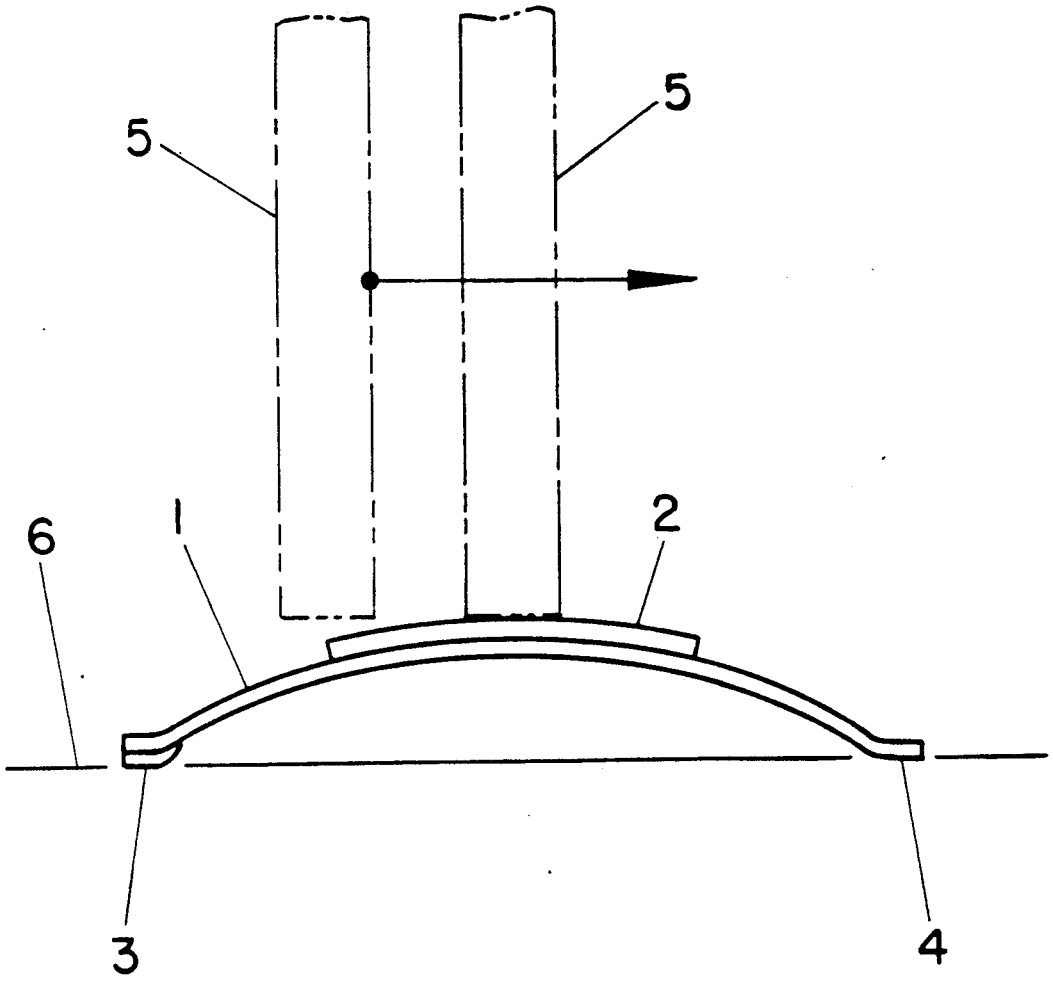
FIG. 4 shows an elevational view of the door stop with a door shown by dotted lines.

The resilience of the strap member is such that the strap member will tend to return to the arch shape thus pushing the central portion upwardly into engagement with the bottom edge of the door 5. The floor is indicated at 6 in FIG. 4 where the two foot surfaces at the under side of the end portions are shown in contact with the floor.

The upper surface of the central portion thus defines a door engaging surface for frictionally contacting the bottom edge of the door.

The door engaging surface of the central portion is covered by a high friction coating material for example, rubber. The foot surface of one of the end portions only is similarly provided with the coating indicated at 2. In this way the door stop is provided with frictional material for engaging the floor and for engaging the underside or bottom edge of the door. However the second foot surface at the end portion 4 has a coating of material which is of reduced frictional properties relative to the coating 2 so as to allow that foot surface to slide on the floor as the arch is compressed.

Figure 1:
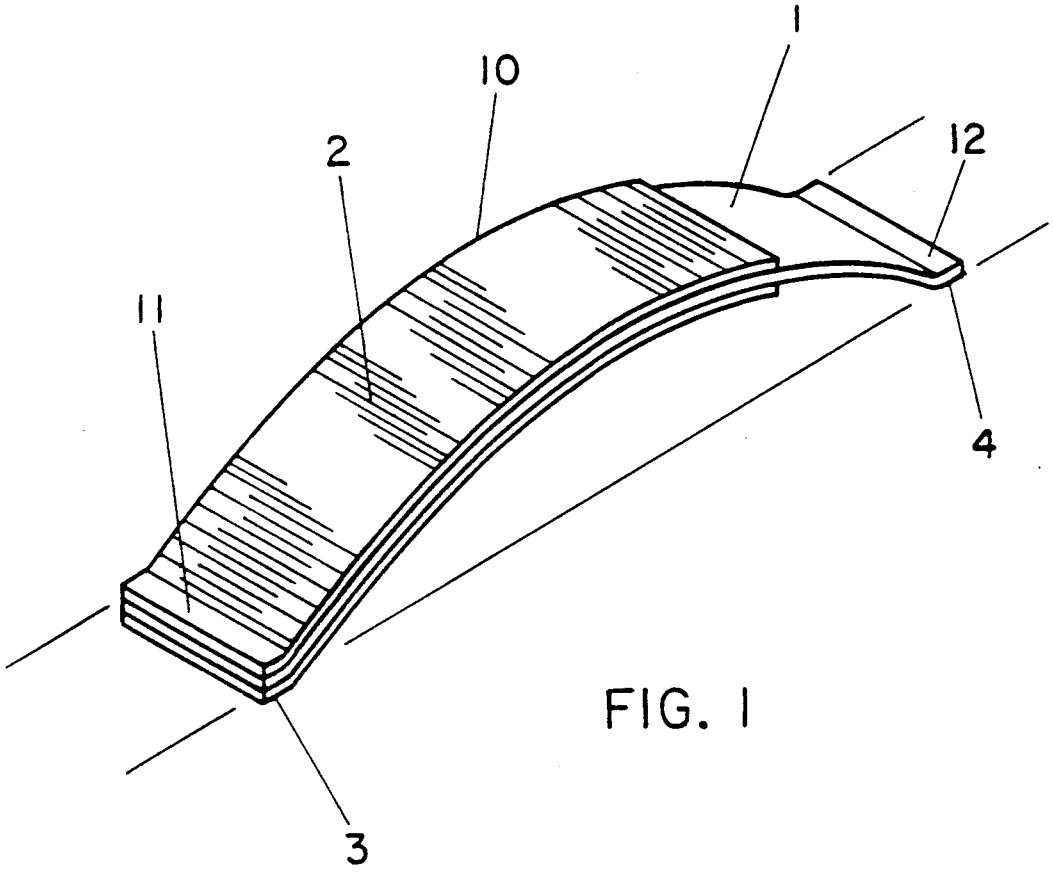
FIG. 1 is an isometric view of the door stop.
Figure 2:
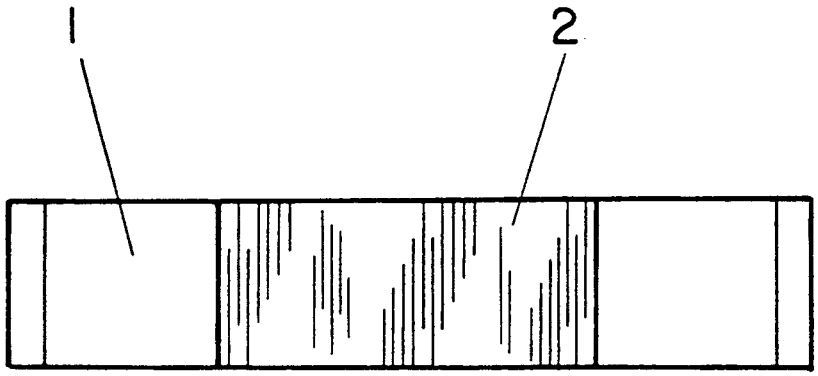
FIG. 2 shows a plan view of the door stop.
Figure 3:
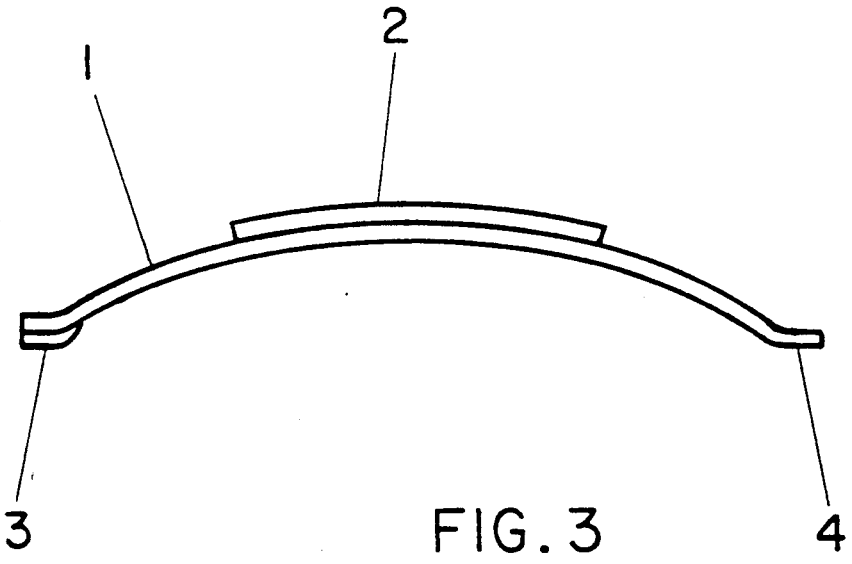
FIG. 3 shows an elevational view of the door stop.

In the arrangement shown in FIG. 1, the coating 2 is applied from the end portion 3 over the whole of the strap up to and including the central portion but not including the end portion 4. In the arrangement shown in FIG. 2, 3 and 4, the coating is applied only on the door engaging surface and on the foot surface of the end portion 3.

In use the door stop is placed on the floor at the spot where the door is to be held. The arch is compressed by downward pressure from the foot of the user and the door is pulled into position on top of the door stop. The arch is then released by removing the foot of the user from the door stop allowing the door stop to expand upward on to the door so that the frictional surfaces can hold the door stationary relative to the floor.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A door stop comprising a spring strap member formed of a thin sheet material and shaped to form an arched central portion, a first end portion and a second end portion arranged at opposed ends of the central portion the spring strap member being symmetrical about a central line transverse to the central portion, the central portion being raised relative to a common plane containing the end portions, a top surface of the central portion defining an upwardly facing door engaging surface for engaging a bottom edge of the door to be stopped, the door stop including door engaging means consisting solely of said upwardly facing door engaging surface, the end portions each defining a downwardly facing floor engaging foot surface, the strap member being elastically deformable to compress the central portion to engage under the bottom edge of the door, elastic force from the strap member being arranged to apply upward force onto the bottom edge of the door to provide the sole engagement therewith, the door engaging surface of the central portion and the foot surface of the first end portion having a friction material thereon of higher frictional characteristics than that of the foot surface of the second end portion.

2. The door stop according to claim 1 which is formed from a sheet metal strap.

3. The door stop according to claim 1 wherein the frictional material is provided by a coating applied onto the strap member.

4. The door stop according to claim 3 wherein the coating is applied from the first portion end of the strap member up to and including the central portion and covers both upper and lower surfaces of the strap member.

* * * * *